US011801581B2

(12) United States Patent
Lu et al.

(10) Patent No.: US 11,801,581 B2
(45) Date of Patent: Oct. 31, 2023

(54) DERUSTING MACHINE

(71) Applicant: Nantong Jinchang Machinery Manufacturing Co., Ltd., Nantong (CN)

(72) Inventors: Fujin Lu, Nantong (CN); Ruibiao Lu, Nantong (CN)

(73) Assignee: NANTONG JINCHANG MACHINERY MANUFACTURING CO., LTD., Nantong (CN)

( * ) Notice: Subject to any disclaimer, the term of this patent is extended or adjusted under 35 U.S.C. 154(b) by 436 days.

(21) Appl. No.: 17/147,416

(22) Filed: Jan. 12, 2021

(65) Prior Publication Data

US 2021/0323112 A1 Oct. 21, 2021

(30) Foreign Application Priority Data

Apr. 15, 2020 (CN) ..... 202010296821.X
Apr. 15, 2020 (CN) ..... 202020557845.1

(51) Int. Cl.

| | |
|---|---|
| ***B24B 27/033*** | (2006.01) |
| ***B08B 15/04*** | (2006.01) |
| ***B24B 55/06*** | (2006.01) |
| ***B24B 41/00*** | (2006.01) |
| ***B24B 41/02*** | (2006.01) |

(52) U.S. Cl.

CPC ..... *B24B 27/033* (2013.01); *B08B 15/04* (2013.01); *B24B 41/002* (2013.01); *B24B 41/02* (2013.01); *B24B 55/06* (2013.01)

(58) Field of Classification Search

None

See application file for complete search history.

(56) References Cited

U.S. PATENT DOCUMENTS

| | | | | |
|---|---|---|---|---|
| 851,111 | A * | 4/1907 | Arnold | B63B 59/08 114/222 |
| 3,885,358 | A * | 5/1975 | Enzian | B24D 13/10 451/526 |
| 4,299,004 | A * | 11/1981 | Lancaster | A47L 17/00 15/97.1 |
| 5,297,363 | A * | 3/1994 | Schroder | B63B 59/06 451/354 |
| 6,173,470 | B1 * | 1/2001 | van Osenbruggen | B24D 13/20 15/179 |
| 9,161,612 | B2 * | 10/2015 | Woods | A47L 11/4041 |

(Continued)

*Primary Examiner* — Brian D Keller
*Assistant Examiner* — Dana Lee Poon
(74) *Attorney, Agent, or Firm* — MATTHIAS SCHOLL P.C.; Matthias Scholl

(57) ABSTRACT

A derusting machine includes at least two derusting wheels; a driving mechanism; a support assembly; a dust hood; a plurality of suction nozzles disposed through the dust hood; a vacuum cleaner; and a pipe. The at least two derusting wheels are perpendicular to each other; each derusting wheel includes a plurality of wire wheels and a rotating wheel disposed between the plurality of wire wheels, and each the rotating wheel includes a carbide bit. The at least two derusting wheels are connected to the driving mechanism. The driving mechanism is disposed in or on the support assembly. The support assembly is a handle, a conveyor, or a support frame. The dust hood is attached to the at least two derusting wheels. The plurality of suction nozzles is connected to the vacuum cleaner through the pipe.

9 Claims, 6 Drawing Sheets

(56) References Cited

U.S. PATENT DOCUMENTS

| | | | | |
|---|---|---|---|---|
| 9,408,458 | B2 * | 8/2016 | Woods | B08B 1/002 |
| 2002/0090900 | A1 * | 7/2002 | Telischak | B24B 23/02 451/359 |

* cited by examiner

DERUSTING MACHINE

CROSS-REFERENCE TO RELATED APPLICATIONS

Pursuant to 35 U.S.C. § 119 and the Paris Convention Treaty, this application claims foreign priority to Chinese Patent Application No. 202010296821.X filed on Apr. 15, 2020, and to Chinese Patent Application No. 202020557845.1 filed on Apr. 15, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, MA 02142.

BACKGROUND

The disclosure relates to a derusting machine.

Derusting is a common process in iron and steel industry. In traditional operations, the operators use wire gauze to remove iron rust through manual grinding, which is time-consuming and laborious, and the rust removal effect is not ideal. The conventional operations can only remove the loose rust, failing to reach the cleanliness level Sa 2.5-3.0 according to ISO8501, a pictorial standard showing the appearance of different rust grades at various levels of cleanliness.

SUMMARY

The disclosure provides a derusting machine comprising at least two derusting wheels; a driving mechanism; a support assembly; a dust hood; a plurality of suction nozzles disposed through the dust hood; a vacuum cleaner; and a pipe. The at least two derusting wheels are perpendicular to each other; each derusting wheel comprises a plurality of wire wheels and a rotating wheel disposed between the plurality of wire wheels, and each the rotating wheel comprises a carbide bit. The at least two derusting wheels are connected to the driving mechanism; the driving mechanism is disposed in or on the support assembly; the support assembly is a handle, a conveyor, or a support frame; the dust hood is attached to the at least two derusting wheels; and the plurality of suction nozzles is connected to the vacuum cleaner through the pipe.

In a class of this embodiment, the driving mechanism comprises a drive motor, a first driving wheel, a bearing seat, and a bevel gear set; the first driving wheel, the bearing seat, and the bevel gear set are disposed on an output shaft of the drive motor sequentially; each of the at least two derusting wheels comprises a rotating shaft; the rotating shaft of one derusting wheel is connected to the drive motor in a transmission way via the bevel gear set; the rotating shaft of another derusting wheel is provided with a first driven wheel; the first driven wheel is connected to the first driving wheel in a transmission way via a belt; and the rotating shaft is fixedly connected to an external mechanism through the bearing seat.

In a class of this embodiment, the handle comprises a housing, a charging interface, a switch button, and a hand-held part; a control circuit board and a storage battery are disposed in the housing; the vacuum cleaner is disposed on the one end of the housing; and the pipe runs through the housing to communicate with the vacuum cleaner.

In a class of this embodiment, the conveyor comprises a conveying frame, a motor, a plurality of conveying rollers, a plurality of driving sprockets, a transmission chain, a second driven wheel, and a second driving wheel; at least two derusting wheels and two driving mechanisms are disposed on the conveying frame; the driving mechanisms are disposed correspondingly to the derusting wheels; the conveying frame is disposed below the at least two derusting wheels; the plurality of conveying rollers is disposed on the conveying frame; one end of each conveying roller extends out of the conveying frame and each of the plurality of driving sprockets is disposed on the one end; the plurality of driving sprockets of the plurality of conveying rollers are connected through the transmission chain; the second driven wheel is disposed on one of the plurality of conveying rollers; the second driving wheel is disposed around an output shaft of the motor; the second driving wheel is connected to the second driven wheel in a transmission way; and the vacuum cleaner is disposed on one side of the conveying frame.

In a class of this embodiment, the support frame comprises an operation platform, a linear guide rail, a slide rail, a mounting base, and a bearing support; the linear guide rail and the slide rail are disposed on two sides of the operation platform, respectively; the mounting base is disposed on the linear guide rail; the driving mechanism is disposed on the mounting base; the bearing support is disposed on one end of the rotating shaft of the derusting wheel back on the driving mechanism; the bearing support is fixedly connected to the slide rail; the driving mechanism drives the derusting wheels to move on the linear guide rail; and the vacuum cleaner is disposed on one side of the operation platform.

In a class of this embodiment, the carbide bit comprises a cutting surface comprising a plurality of elastic serrations.

In a class of this embodiment, the wire wheel comprises a plurality of steel wires, and each steel wire comprises a bent free end.

In a class of this embodiment, the plurality of suction nozzles is equidistantly disposed and inclined towards the derusting wheels.

In a class of this embodiment, the vacuum cleaner comprises a detachable cylindrical dust collector.

The following advantages are associated with the derusting machine of the disclosure. When the derusting wheels are rotating, the plurality of wire wheels contacts a steel plate directly to remove the rust thereon. At the same time, the carbide bit on the rotating wheel scratches the steel plate longitudinally and transversely, which increases the surface roughness of the steel plate and makes the surface structure of the steel plate reach the cleanliness level Sa 2.5-3.0.

Figure 1:
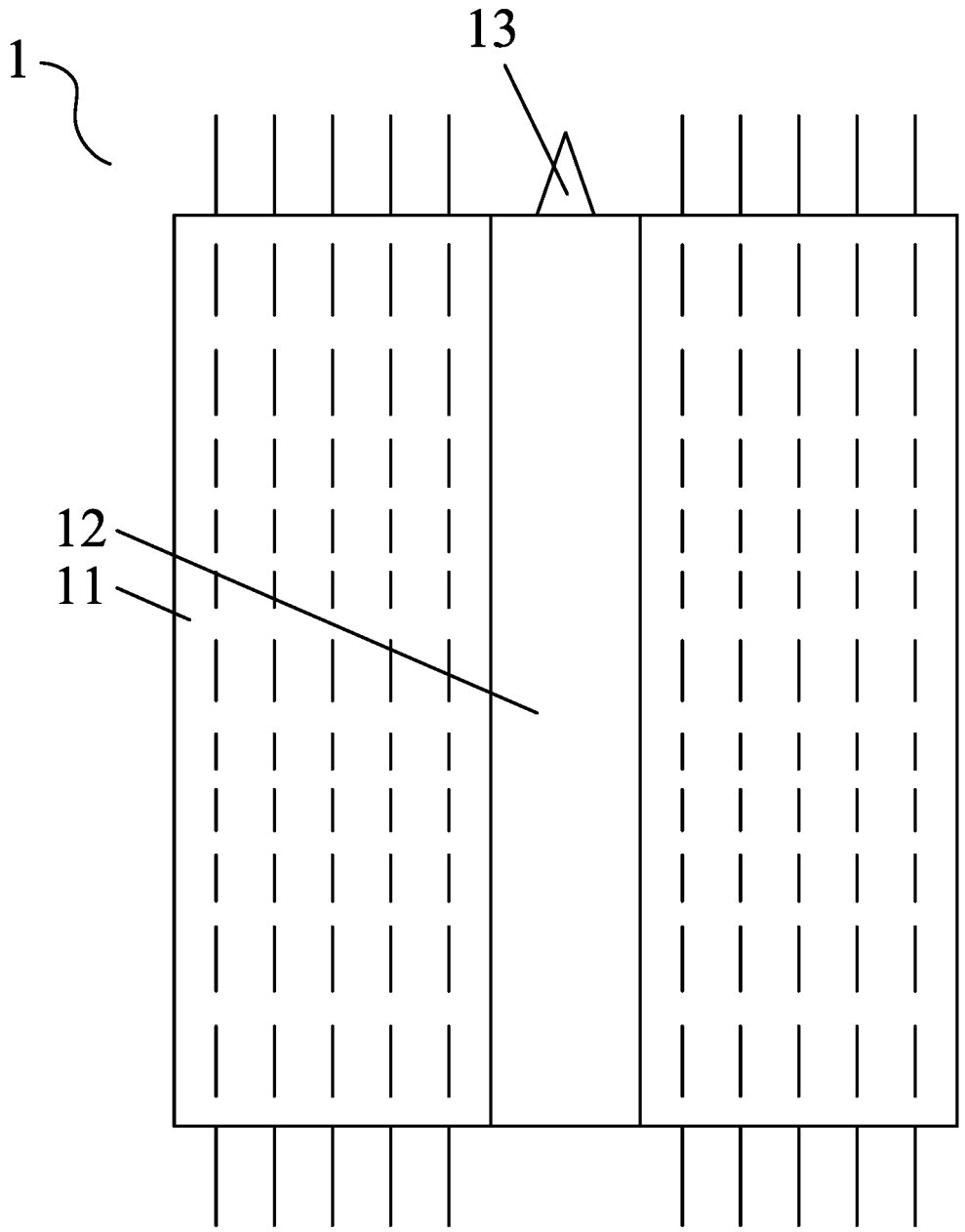
FIG. 1 is a top view of a derusting wheel of a derusting machine in accordance with one embodiment of the disclosure.

In the drawings, the following reference numbers are used: 1. Derusting wheel; 11. Wire wheel; 12. Rotating wheel; 13. Carbide bit; 2. Driving mechanism; 21. Drive motor; 22. First driving wheel; 23. Bearing seat; 24. Bevel gear set; 25. Rotating shaft; 26 First driven wheel; 3. Handle; 31. Housing; 32. Charging interface; 33. Switch button; 34. Hand-held part; 4. Conveyor; 41. Conveying frame; 42. Motor; 43. Conveying roller; 44. Driving sprocket; 45. Transmission chain; 46. Second driven wheel; 47. Second driving wheel; 5. Support frame; 51. Operation platform; 52. Linear guide rail; 53. Slide rail; 54. Mounting base; 55. Bearing support; 6. Dust hood; 7. Suction nozzle; 8. Pipe; 9. Vacuum cleaner.

DETAILED DESCRIPTION

To further illustrate, embodiments detailing a derusting machine are described below. It should be noted that the following embodiments are intended to describe and not to limit the disclosure.

Example 1

Figure 2:
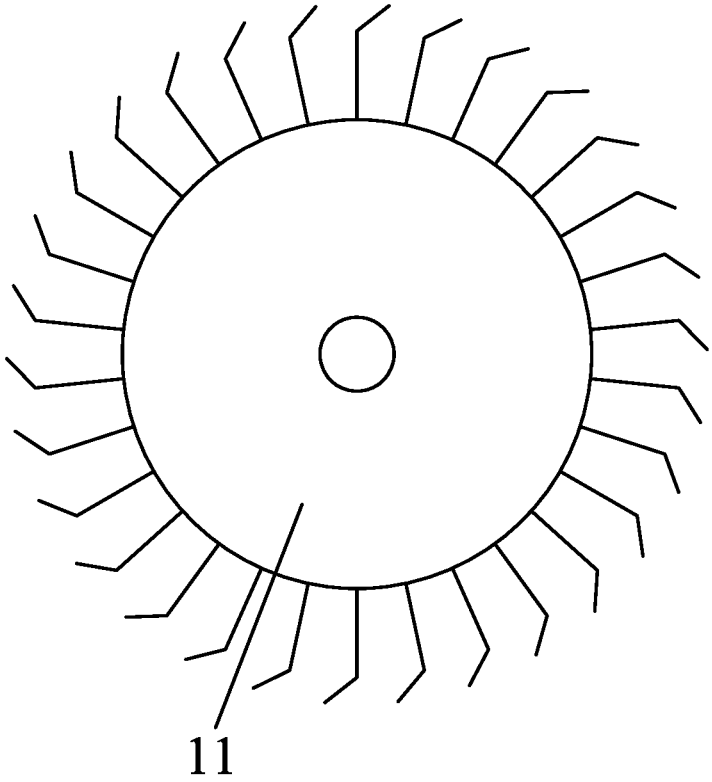
FIG. 2 is a side view of a wire wheel of a derusting machine in accordance with one embodiment of the disclosure.
Figure 3:
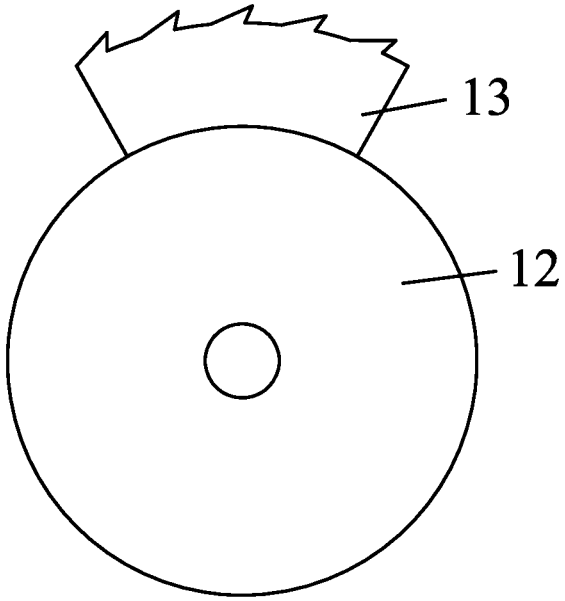
FIG. 3 is a side view of a rotating wheel of a derusting machine in accordance with one embodiment of the disclosure.
Figure 4:
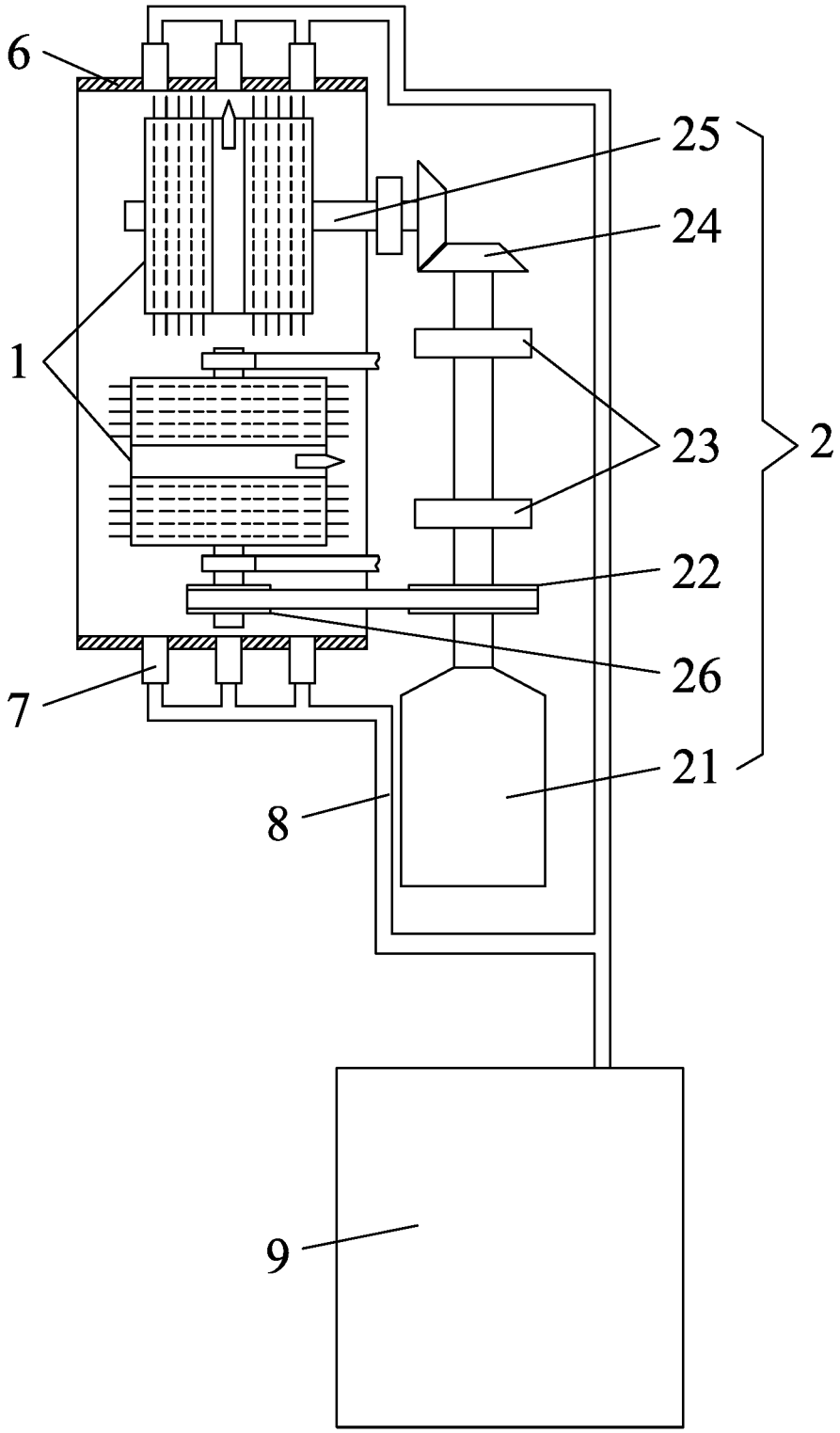
FIG. 4 is a schematic diagram of a derusting wheel and a driving mechanism of a derusting machine in accordance with one embodiment of the disclosure.
Figure 5:
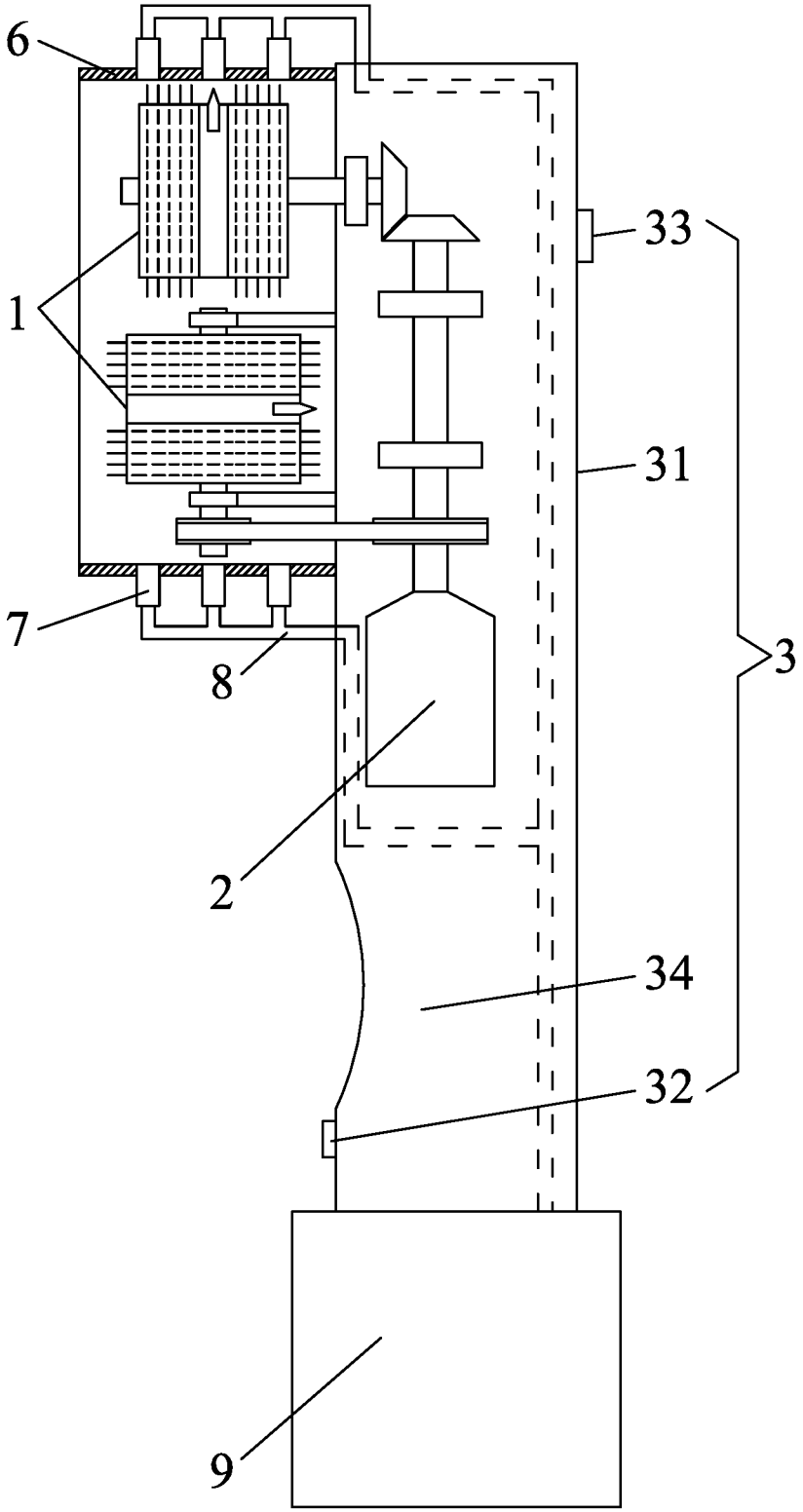
FIG. 5 is a top view of a derusting machine in Example 1 of the disclosure.

As shown in FIGS. 1-5, the disclosure provides a derusting machine. The derusting machine comprises at least two derusting wheels 1 which are perpendicular to each other, for example, one is disposed in the transverse direction of the derusting machine, and the other is disposed in the longitudinal direction of the derusting machine. Each of the at least two derusting wheels 1 comprises a plurality of wire wheels 11 and a rotating wheel 12, and the rotating wheel 12 is disposed between the wire wheels 11. The rotating wheel 12 comprises a carbide bit 13. Each of the at least two derusting wheels 1 is connected to a driving mechanism 2. The driving mechanism 2 is disposed in a handle 3. A dust hood 6 is attached to the derusting wheel 1. A plurality of suction nozzles 7 is disposed through the dust hood 6. The plurality of suction nozzles 7 is connected to a vacuum cleaner 9 through a pipe 8. Specifically, when the derusting wheels 1 are rotating, the plurality of wire wheels 11 contacts a steel plate directly to remove the rust on the steel plate. At the same time, the carbide bit 13 on the rotating wheel 12 scratches the steel plate longitudinally and transversely, which increases the surface roughness of the steel plate and makes the surface structure of the steel plate reach the cleanliness level Sa 2.5-3.0. The handle 3 where the driving mechanism 2 is disposed is compact, easy to carry, suitable for outdoor operation, thus improving the work efficiency, reducing the labor intensity of workers, saving the cost, and ensuring the product quality. The dust produced in the rust removal process is sucked into the suction nozzle 7, transported via the pipe 8, and stored in the vacuum cleaner 9. The dust hood 6 prevents the rust from being blown away by the wind, ensuring the health of the operators. The iron scraps can be recycled thus saving the costs and resources.

In the example, the driving mechanism 2 comprises a drive motor 21, a first driving wheel 22, a bearing seat 23, and a bevel gear set 24. The first driving wheel 22, the bearing seat 23, and the bevel gear set 24 are disposed on the output shaft of the drive motor 21 sequentially. Each of the at least two derusting wheels 1 comprises a rotating shaft 25. The rotating shaft of one derusting wheel is connected to the drive motor 21 in a transmission way via the bevel gear set 24. The rotating shaft of another derusting wheel is provided with a first driven wheel 26. The first driven wheel 26 is connected to the first driving wheel 22 in a transmission way via a belt. The rotating shaft is fixedly connected to an external mechanism through the bearing seat 23. Specifically, when the drive motor 21 is started, the first driving wheel 22 and the bevel gear set 24 are driven to rotate, thereby driving the rotating shaft 25 to rotate. Thus, the at least two derusting wheels 1 rotate to remove dust of the steel plate.

Specifically, the handle 3 comprises a housing 31, a charging interface 32, a switch button 33, and a hand-held part 34. A control circuit board and a storage battery are disposed in the housing 31. The vacuum cleaner 9 is disposed on the one end of the housing 31. The pipe 8 runs through the housing 31 to communicate with the vacuum cleaner 9. In certain embodiments, the size of the handle is similar to that of a hand-held cutting machine, which is easy to carry.

Specifically, the cutting surface of the carbide bit 13 comprises a plurality of elastic serrations, which is convenient to scratch the surface of the steel plate thus improving the work efficiency.

Specifically, the wire wheel 11 comprises a plurality of steel wires, and each steel wire comprises a bent free end. When the wire wheel rotates, the steel plate is shoveled by the steel wire, thus improving the dust removal efficiency.

Specifically, the derusting machine comprises a plurality of suction nozzles 7 equidistantly disposed and inclined towards the derusting wheels 1 to suck the rising iron filings and rust.

Specifically, the vacuum cleaner 9 comprises a detachable cylindrical dust collector, which is convenient for cleaning and recycling of the vacuum cleaner.

Example 2

Figure 6:
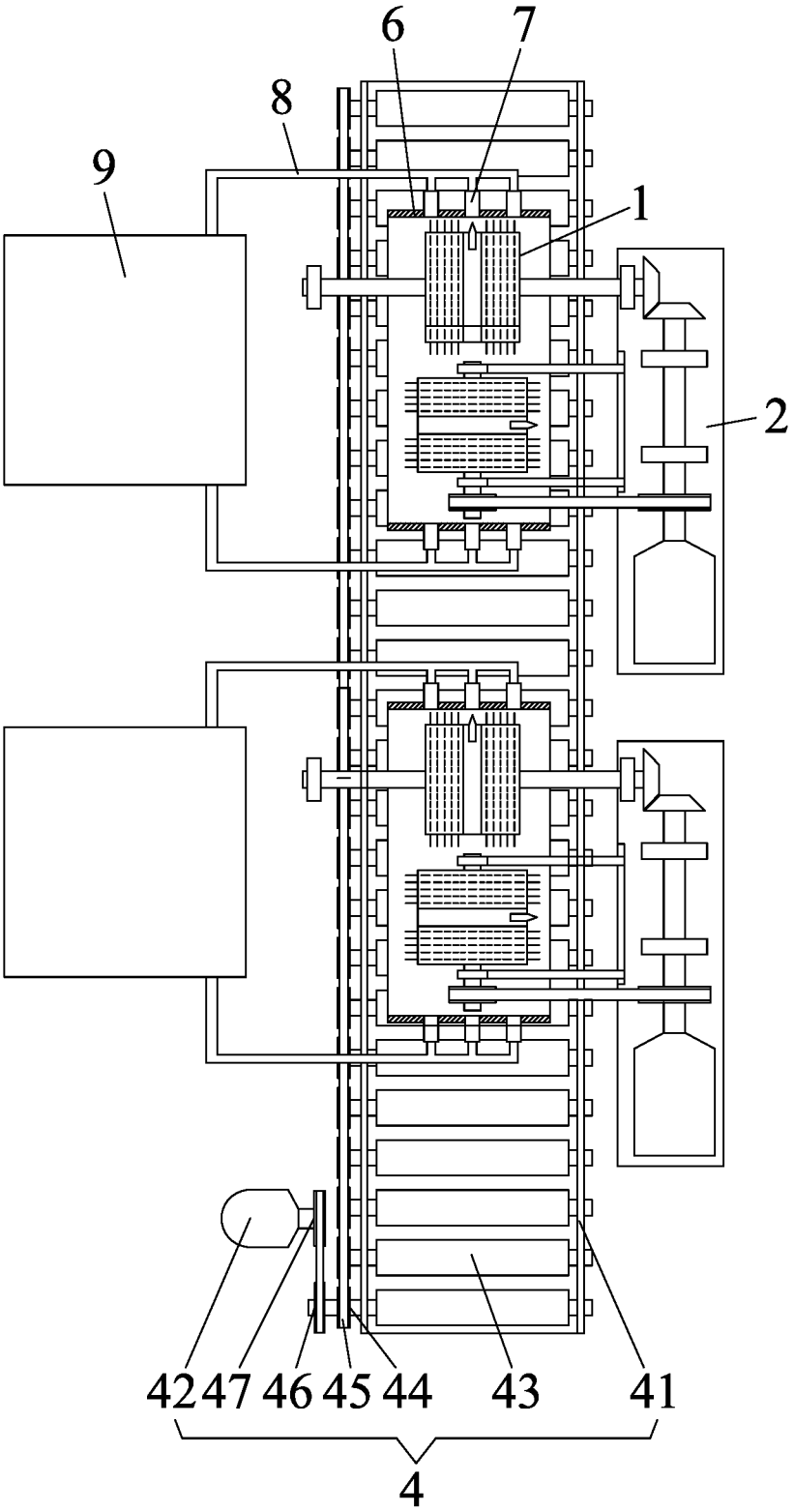
FIG. 6 is a top view of a derusting machine in Example 2 of the disclosure.

As shown in FIGS. 1-4 and 6, the disclosure provides a derusting machine. The derusting machine comprises at least two derusting wheels 1 which are perpendicular to each other, for example, one is disposed in the transverse direction of the derusting machine, and the other is disposed in the longitudinal direction of the derusting machine. The derusting wheel 1 comprises a plurality of wire wheels 11 and a rotating wheel 12, and the rotating wheel 12 is disposed between the wire wheels 11. The rotating wheel 12 comprises a carbide bit 13. The derusting wheel 1 is connected to a driving mechanism 2. The driving mechanism 2 is disposed on a conveyor 4. A dust hood 6 is attached to the derusting wheel 1. A plurality of suction nozzles 7 is disposed through the dust hood 6. The plurality of suction nozzles 7 is connected to a vacuum cleaner 9 through a pipe 8. Specifically, when the derusting wheel 1 is rotating, the plurality of wire wheels 11 contacts a steel plate directly to remove the rust on the steel plate. At the same time, the carbide bit 13 on the rotating wheel 12 scratches the steel plate longitudinally and transversely, which increases the surface roughness of the steel plate and makes the surface structure of the steel plate reach the cleanliness level Sa 2.5-3.0.

In the example, the driving mechanism 2 comprises a drive motor 21, a first driving wheel 22, a bearing seat 23, and a bevel gear set 24. The first driving wheel 22, the bearing seat 23, and the bevel gear set 24 are disposed on the output shaft of the drive motor 21 sequentially. Each of the at least two derusting wheels 1 comprises a rotating shaft 25.

The rotating shaft of one derusting wheel is connected to the drive motor 21 in a transmission way via the bevel gear set 24. The rotating shaft of another derusting wheel is provided with a first driven wheel 26. The first driven wheel 26 is connected to the first driving wheel 22 in a transmission way via a belt. The rotating shaft is fixedly connected to an external mechanism through the bearing seat 23. Specifically, when the drive motor 21 is started, the first driving wheel 22 and the bevel gear set 24 are driven to rotate, thereby driving the rotating shaft 25 to rotate. Thus, the at least two derusting wheels 1 rotate to remove dust of the steel plate.

The conveyor 4 comprises a conveying frame 41. At least two derusting wheels 1 and two driving mechanisms are disposed on the conveying frame 41. The driving mechanisms are disposed correspondingly to the derusting wheels. The conveying frame 41 is disposed below the at least two derusting wheels 1. The conveying frame 41 is driven by a motor 42. The conveying frame 41 comprises a plurality of conveying rollers 43. One end of each conveying roller extends out of the conveying frame and a driving sprocket 44 is disposed on the one end. The driving sprockets 44 of the plurality of conveying rollers 43 are connected through a transmission chain 45. One of the plurality of conveying rollers is provided with a second driven wheel 46. A second driving wheel 47 is disposed around the output shaft of the motor 42. The second driving wheel 47 is connected to the second driven wheel 46 in a transmission way. The vacuum cleaner 9 is disposed on one side of the conveying frame 41. Specifically, the conveying frame 41 is configured to transport the steel plates to the derusting wheels for dust removal. When in operation, the motor 42 is started, and the second driving wheel 47 is driven to rotate, thereby driving the second driven wheel 46 to rotate. The rotation of the second driven wheel 46 drives the driving sprocket 44 coaxial with the second driven wheel to rotate. Because the driving sprockets 44 of the plurality of conveying rollers 43 are connected through the transmission chain 45, all the driving sprockets 44 start to rotate. Thus, the plurality of conveying rollers 43 start rotating to transport the steel plates.

Specifically, the cutting surface of the carbide bit 13 comprises a plurality of elastic serrations, which is convenient to scratch the surface of the steel plate thus improving the work efficiency.

Specifically, the wire wheel 11 comprises a plurality of steel wires, and each steel wire comprises a bent free end. When the wire wheel rotates, the steel plate is shoveled by the steel wire, thus improving the dust removal efficiency.

Specifically, the derusting machine comprises a plurality of suction nozzles 7 equidistantly disposed and inclined towards the derusting wheels 1 to suck the rising iron filings and rust.

Specifically, the vacuum cleaner 9 comprises a detachable cylindrical dust collector, which is convenient for cleaning and recycling of the vacuum cleaner.

Example 3

Figure 7:
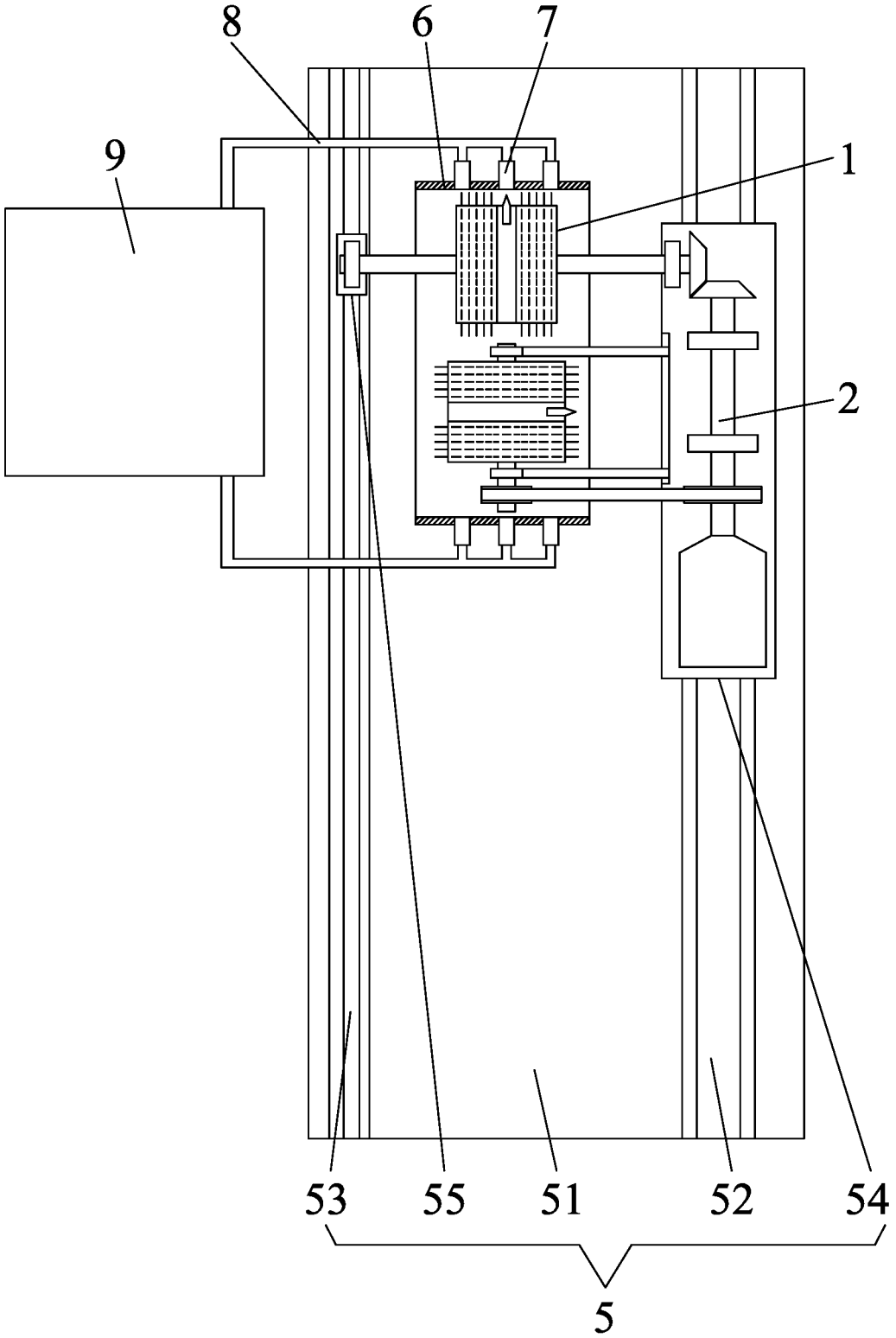
FIG. 7 is a top view of a derusting machine in Example 3 of the disclosure.

As shown in FIGS. 1-4 and 7, the disclosure provides a derusting machine. The derusting machine comprises at least two derusting wheels 1 which are perpendicular to each other, for example, one is disposed in the transverse direction of the derusting machine, and the other is disposed in the longitudinal direction of the derusting machine. The derusting wheel 1 comprises a plurality of wire wheels 11 and a rotating wheel 12, and the rotating wheel 12 is disposed between the wire wheels 11. The rotating wheel 12 comprises a carbide bit 13. The derusting wheel 1 is connected to a driving mechanism 2. The driving mechanism 2 is disposed in a handle 3. A dust hood 6 is attached to the derusting wheel 1. A plurality of suction nozzles 7 is disposed through the dust hood 6. The plurality of suction nozzles 7 is connected to a vacuum cleaner 9 through a pipe 8. Specifically, when the derusting wheel 1 is rotating, the plurality of wire wheels 11 contacts a steel plate directly to remove the rust on the steel plate. At the same time, the carbide bit 13 on the rotating wheel 12 scratches the steel plate longitudinally and transversely, which increases the surface roughness of the steel plate and makes the surface structure of the steel plate reach the cleanliness level Sa 2.5-3.0.

In the example, the driving mechanism 2 comprises a drive motor 21, a first driving wheel 22, a bearing seat 23, and a bevel gear set 24. The first driving wheel 22, the bearing seat 23, and the bevel gear set 24 are disposed on the output shaft of the drive motor 21 sequentially. Each of the at least two derusting wheels 1 comprises a rotating shaft 25. The rotating shaft of one derusting wheel is connected to the drive motor 21 in a transmission way via the bevel gear set 24. The rotating shaft of another derusting wheel is provided with a first driven wheel 26. The first driven wheel 26 is connected to the first driving wheel 22 in a transmission way via a belt. The rotating shaft is fixedly connected to an external mechanism through the bearing seat 23. Specifically, when the drive motor 21 is started, the first driving wheel 22 and the bevel gear set 24 are driven to rotate, thereby driving the rotating shaft 25 to rotate. Thus, the at least two derusting wheels 1 rotate to remove dust of the steel plate.

The support frame 5 comprises an operation platform 51, a linear guide rail 52, a slide rail 53, a mounting base 54, and a bearing support 55. The linear guide rail 52 and the slide rail 53 are disposed on two sides of the operation platform 51, respectively. The mounting base 54 is disposed on the linear guide rail 52. The driving mechanism 2 is disposed on the mounting base 54. The bearing support 55 is disposed on one end of the rotating shaft of the derusting wheel 1 back on the driving mechanism. The bearing support 55 is fixedly connected to the slide rail 53. The driving mechanism 2 drives the derusting wheels 1 to move on the linear guide rail 52. The vacuum cleaner 9 is disposed on one side of the operation platform 51. Specifically, the steel plate is disposed on the operation platform 51. In operation, the linear guide rail 52 drives the derusting wheels 1 to move on the linear guide rail 52, and the derusting wheels 1 scratch the steel plates longitudinally and transversely for rust removal.

Specifically, the cutting surface of the carbide bit 13 comprises a plurality of elastic serrations, which is convenient to scratch the surface of the steel plate thus improving the work efficiency.

Specifically, the wire wheel 11 comprises a plurality of steel wires, and each steel wire comprises a bent free end. When the wire wheel rotates, the steel plate is shoveled by the steel wire, thus improving the dust removal efficiency.

Specifically, the derusting machine comprises a plurality of suction nozzles 7 equidistantly disposed and inclined towards the derusting wheels 1 to suck the rising iron filings and rust.

Specifically, the vacuum cleaner 9 comprises a detachable cylindrical dust collector, which is convenient for cleaning and recycling of the vacuum cleaner.

The derusting machine of the disclosure can be applied to flat steel plates and

It will be obvious to those skilled in the art that changes and modifications may be made, and therefore, the aim in the appended claims is to cover all such changes and modifications.

What is claimed is:

1. A device, comprising:

at least two derusting wheels which are perpendicular to each other, each derusting wheel comprising a plurality of wire wheels and a rotating wheel disposed between the plurality of wire wheels;

a carbide bit disposed on the rotating wheel;

a driving mechanism;

a support assembly;

a dust hood;

a plurality of suction nozzles disposed through the dust hood;

a vacuum cleaner; and a pipe;

wherein:

the at least two derusting wheels are connected to the driving mechanism;

the driving mechanism is disposed in or on the support assembly;

the support assembly is a handle, a conveyor, or a support frame;

the dust hood is attached to the at least two derusting wheels; and the plurality of suction nozzles is connected to the vacuum cleaner through the pipe.

2. The device of claim 1, wherein the driving mechanism comprises a drive motor, a first driving wheel, a bearing seat, and a bevel gear set; the first driving wheel, the bearing seat, and the bevel gear set are disposed on an output shaft of the drive motor sequentially; each of the at least two derusting wheels comprises a rotating shaft; the rotating shaft of one derusting wheel is connected to the drive motor in a transmission way via the bevel gear set; the rotating shaft of another derusting wheel is provided with a first driven wheel; the first driven wheel is connected to the first driving wheel in a transmission way via a belt; and each rotating shaft is fixedly connected to an external mechanism through the bearing seat.

3. The device of claim 1, wherein the handle comprises a housing, a charging interface, a switch button, and a handheld part; a control circuit board and a storage battery are disposed in the housing; the vacuum cleaner is disposed on the one end of the housing; and the pipe runs through the housing to communicate with the vacuum cleaner.

4. The device of claim 1, wherein the conveyor comprises a conveying frame, a motor, a plurality of conveying rollers, a plurality of driving sprockets, a transmission chain, a second driven wheel, and a second driving wheel; at least two derusting wheels and two driving mechanisms are disposed on the conveying frame; the driving mechanisms are disposed correspondingly to the derusting wheels; the conveying frame is disposed below the at least two derusting wheels; the plurality of conveying rollers is disposed on the conveying frame; one end of each conveying roller extends out of the conveying frame and each of the plurality of driving sprockets is disposed on the one end; the plurality of driving sprockets of the plurality of conveying rollers are connected through the transmission chain; the second driven wheel is disposed on one of the plurality of conveying rollers; the second driving wheel is disposed around an output shaft of the motor; the second driving wheel is connected to the second driven wheel in a transmission way; and the vacuum cleaner is disposed on one side of the conveying frame.

5. The device of claim 1, wherein the support frame comprises an operation platform, a linear guide rail, a slide rail, a mounting base, and a bearing support; the linear guide rail and the slide rail are disposed on two sides of the operation platform, respectively; the mounting base is disposed on the linear guide rail; the driving mechanism is disposed on the mounting base; the bearing support is disposed on one end of the rotating shaft of one of the at least two derusting wheels back on the driving mechanism; the bearing support is fixedly connected to the slide rail; the driving mechanism drives the at least two derusting wheels to move on the linear guide rail; and the vacuum cleaner is disposed on one side of the operation platform.

6. The device of claim 1, wherein the carbide bit comprises a cutting surface comprising a plurality of elastic serrations.

7. The device of claim 1, wherein the wire wheel comprises a plurality of steel wires, and each steel wire comprises a bent free end.

8. The device of claim 1, wherein the plurality of suction nozzles is equidistantly disposed on the dust hood and inclined towards the derusting wheels.

9. The device of claim 1, wherein the vacuum cleaner comprises a detachable cylindrical dust collector.

* * * * *